US005756161A

United States Patent [19]

Taylor

[11] Patent Number: 5,756,161

[45] Date of Patent: May 26, 1998

[54] SCOURING PAD AND PROCESS FOR MAKING SAME

[75] Inventor: John C. Taylor, Phoenix, Ariz.

[73] Assignee: The Dial Corporation, Phoenix, Ariz.

[21] Appl. No.: 557,954

[22] Filed: Nov. 14, 1995

[51] Int. Cl.[6] ..... B05D 3/00

[52] U.S. Cl. ..... 427/398.1; 134/4; 427/8; 427/428; 427/439; 427/443

[58] Field of Search ..... 427/8, 389.9, 391, 427/393.5, 428, 439, 443, 398.1; 134/4

[56] References Cited

U.S. PATENT DOCUMENTS

| | | | |
|---|---|---|---|
| 3,112,584 | 12/1963 | Cameron | 51/185 |
| 3,284,963 | 11/1966 | Lanham et al. | 51/400 |
| 3,537,121 | 11/1970 | McAvoy | 15/230.12 |
| 4,078,340 | 3/1978 | Klecker et al. | 51/295 |
| 4,267,215 | 5/1981 | Riggs | 427/428 X |
| 4,991,362 | 2/1991 | Heyer et al. | 51/400 |
| 5,152,809 | 10/1992 | Mattesky | 51/295 |

FOREIGN PATENT DOCUMENTS 1010935 11/1965 United Kingdom .

*Primary Examiner*—Michael Lusignan
*Attorney, Agent, or Firm*—Michael A. Lechter; David E. Rogers

[57] ABSTRACT

A process and apparatus for impregnating a molten or viscous cleaning composition into a traveling, three dimensional, lofty, dense nonwoven web is disclosed. The composition is applied by an applicator manifold and is retained in the voids within the web. The velocity of the web and the flow of the cleaning composition are adjusted depending on the viscosity of the composition and the web density. Additionally, the viscosity of the composition can be controlled by altering its temperature or by altering the line pressure. The process eliminates the use of a doctor blade, spray system and application roll to meter the amount of cleaning composition into the web, and is suitable for the application of a molten or very viscous chemical compositions into a lofty, dense nonwoven web.

20 Claims, 2 Drawing Sheets

SCOURING PAD AND PROCESS FOR MAKING SAME

TECHNICAL FIELD OF THE INVENTION

The present invention relates to processes for forming pads of nonwoven material with a suitable dried cleansing composition therein, and to pads formed by such processes, and, particularly, a nonscratching, low abrasive cleansing pad.

BACKGROUND OF THE INVENTION

Scouring and polishing pads for use at home and in various industrial applications are well known in the art. Initially, metal wool, such as steel wool, was widely used for scouring household articles such as pots, pans and the like. Similar scouring and polishing pads made of steel wool strands which have been mated together or interwoven into a mass of filaments have also been employed in the industrial field for the removal of substances from surfaces. The metal wool pads had the advantage of deriving their abrasive characteristics and their scouring action from the relative hardness of the metal. Metal wool pads, and particularly steel wool, however, had several disadvantages, including but not limited to, unsightly oxidation (e.g., rusting), breaking or splintering and inability to retain their form and shape.

In order to overcome those disadvantages, the metal pads were in some instances replaced with nonmetallic scouring pads. Accordingly, several scouring pads utilizing synthetic, organic fibers such as nylon, polypropylene, vinyl chlorides, rayon acetates, and other polyesters were developed. Those pads are relatively stable at temperatures likely to be encountered in household and industrial uses and are resistant to corrosive action of other organic chemicals. Furthermore, they are flexible, reliable and economical. Another advantage of those synthetic organic materials is that they may be formed into monofilaments which can be felted into porous open mats or batts of unusually high loft, springiness and compressibility. Examples of such prior art pads are disclosed in U.S. Pat. Nos. 5,152,809 issued on Oct. 6, 1992 to Mattesky; 4,991,362 issued on Feb. 12, 1991 to Heyer, et al.; 4,078,340 issued on Mar. 14, 1978 to Klecker, et al.; 3,537,121 issued on Nov. 3, 1970 to McAvoy; 3,284,963 issued on Nov. 15, 1966 to Lanham, et al.; 3,112,584 issued on Dec. 3, 1963 to Cameron, and United Kingdom Patent No. 1,010,935 published on Nov. 24, 1965 to Klein.

There are several functional and physical characteristics desirable in a scouring pad: the ability to provide a good abrasive action without scratching the surface being cleaned; an open or loft structure relatively unsusceptible to matting or clogging by material removed in the cleaning process; to be oxidation free (rust-free); sufficient resilience for comfortable handling and conformance to irregular contours in the article to be cleansed; the ability to retain a self-contained supply of a cleaning agent and to minimize the waste of detergent; and sufficient strength to endure the rigors of the cleansing operation, to maintain its structural integrity and to prevent tearing or disintegration thereof.

Prior cleansing pads were disadvantageous in that none of those pads combined the above desirable characteristics in one pad. Another disadvantage was that none of those pads had the appropriate abrasiveness for effecting satisfactory cleaning action without scratching soft metal surfaces (e.g., aluminum, copper or the like) and more delicate surfaces made of an tetraflouroethene homopolymer(e.g., Teflon™) or fine china.

In general, processes for the manufacture of such pads and for impregnating such pads with cleaning composition are known. Such prior art processes typically involve dipping the nonwoven material in a trough containing liquid cleaning composition (generally maintained at a temperature sufficiently high to ensure that the cleaning composition stays liquid, then compressing the nonwoven material to remove excess cleaning composition. Steel wool scouring pads impregnated with cleaning composition are typically formed by a similar manner. A predetermined amount of steel wool is placed in a compression chamber. The chamber is flooded with liquid cleaning composition. The pad is then compressed to remove the excess fluid. Such processes, however, do not provide for accurate control of the amount of cleaning composition retained in the pads and are not generally suitable for mass production of relatively thick nonwoven pads. In addition, the processes tend to be inefficient and wasteful.

SUMMARY OF THE INVENTION

The present invention provides a process for manufacturing of a cleansing pad comprising a body of integrated nonwoven lofty open material having a controlled amount of a suitable dried cleansing composition uniformly dispersed throughout the pad.

In accordance with one aspect of the present invention the cleansing pad is formed from a relatively thick web of nonwoven material, e.g., in the range of about 0.125 to 3 inches, preferably 0.80 inches, without substantial waste of cleaning composition.

In accordance with another aspect of the present invention the cleansing pad includes a predetermined ratio by weight of dried cleaning composition to web material. For example, the cleansing composition may be a dried surfactant in the amount of about 0.8 to about 1.2 grams of dried surfactant per gram of web material, and, preferably about one (1) gram of dried surfactant per gram of web material.

In accordance with another aspect of the present invention a cleansing pad is provided which is capable of substantial scouring and polishing action but which is suitable for use on delicate and soft surfaces made of such as soft metal (e.g., aluminum, copper or the like), non-stick materials (e.g., Teflon) or fine china. The pad includes a lofty nonwoven web of a plurality of polyester fibers and a cleansing composition dispersed in the voids within the web.

In accordance with another aspect of the present invention the dried cleaning composition is the end product of a liquid surfactant blend which contains nonionic and anionic surfactants, hydrotrope, alkali agent and a suitable solvent (e.g., water). Suitably, the cleaning composition includes: one or more nonionic surfactant(s) selected from the group of high hydrophilic-lipophilic balance (HLB) alkyl ethoxylated phenol, (a high HLB) alkyl ethoxylated alcohol, coconut monoethanolamide, stearic monoethanolamide, coconut diethanolamide and amine oxide; one or more anionic surfactant(s) selected from the group of alkali metal alkylbenzene sulfonate, sodium dodecylbenzene sulfonate, sodium undecylbenzene sulfonate, potassium dodecylbenzene sulfonate, potassium undecylbenzene sulfonate, sodium lauryl sulfate, and sodium lauryl ethyl sulfate; and amphoterics, such as cocamidopropyl betaine; one or more alkali agents selected from the group of sodium hydroxide, potassium hydroxide, sodium carbonate, and potassium carbonate; one or more hydrotropes selected from the group of sodium xylene sulfonate, sodium benzene sulfonate and sodium toluene sulfonate; and a solvent selected from the group of water, alcohols, and glycols. The preferred blend comprises water, stearic monoethanolamide, coconut monoethanolamide, dodecylbenzene sulfonic acid, sodium xylene sulfonate, sodium hydroxide and sodium lauryl sulfate.

In accordance with another aspect of the present invention the viscosity of the cleaning composition is controlled by controlling the temperature and dilution of the hydrated surfactant blend to ensure that the composition can penetrate a thick, dense nonwoven. For example, viscosity ranges of 80 to 160 cps is obtained in temperature ranges of 150° to 120°.

In accordance with another aspect of the present invention the flow rate of the cleaning composition is controlled by controlling pump pressure and composition viscosity. For example, the flow rate can be controlled to correspond to a preferable nonwoven web speed of 11 to 19 ft/minute.

In accordance with another aspect of the present invention the composition is applied with an applicator manifold. The manifold is suitably heated to maintain the flowable medium at about 160° F. and is placed sufficiently close to the web, in the preferred range of one to two centimeters, to flow composition onto the web so as to impregnate it.

BRIEF DESCRIPTION OF THE DRAWING

A preferred exemplary embodiment of the present invention will hereinafter be described in conjunction with the appended drawing, wherein like designations denote like elements and.

DESCRIPTION OF THE PREFERRED EXEMPLARY EMBODIMENTS

Figure 1:
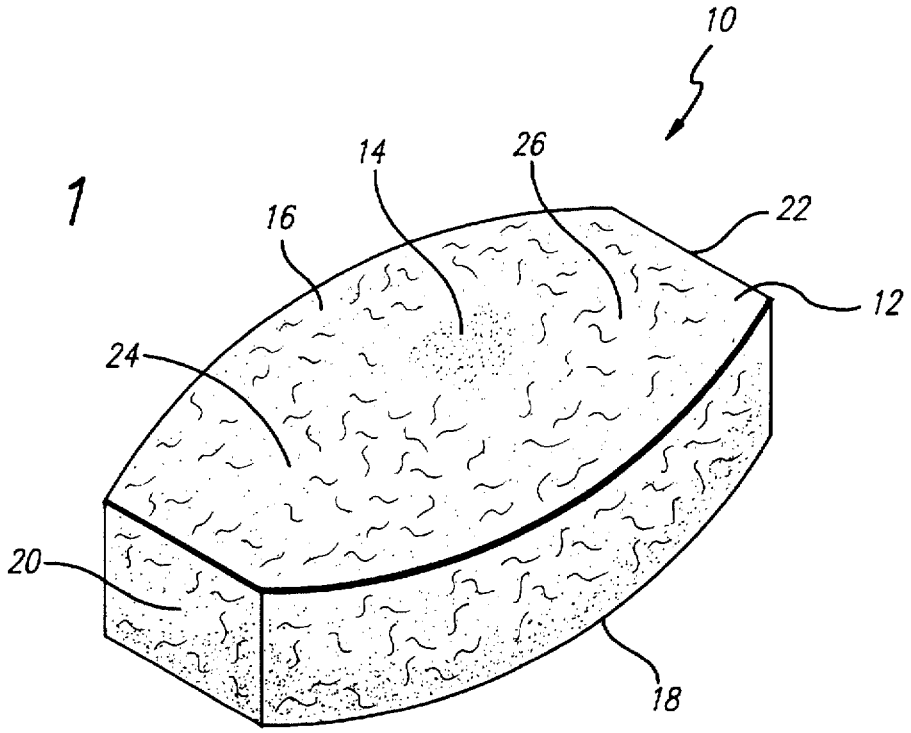
FIG. 1 is a front perspective view of a cleansing pad made in accordance with the present invention.

Referring now to FIG. 1, a cleansing pad 10 made in accordance with various aspects of the present invention includes a three dimensional lofty nonwoven body 12 made of e.g., polyester fibers and a predetermined amount of suitable dried cleansing composition 14 retained in the voids within body 12.

Although the size and shape of pad 10 may vary without departing from the spirit of the invention, it is preferred that pad 10 have an elliptical shape (with focal points 24 and 26) with generally flat upper and lower surfaces 16 and 18 and flat ends 20 and 22. Pad 10 suitably has a major axis length of about 3.25 inches, a minor axis width of about two (2) inches, an end width of about one (1) inch on either end 20 and 22, and a thickness in the range of about 0.125 to 3 inches, typically from 0.75 to about one (1) inch, and preferably 0.80 inches. Focal points 24 and 26 are suitably about one (1) inch from the center of the major axis.

Body 12 may be formed of any high loft nonwoven material mated and bonded through any suitable web forming and binding process. Body 12 is preferably a high loft nonwoven material constructed of filaments of blue homopolymer polyester fibers, made through a dry or air laid web forming process with binders, and a needle punch bonding process. The binder is preferably a detergent resistant thermoset-thermoplastic resin added to the fibers by any suitable technique. If desired, a suitable abrasive can be incorporated into web 12, e.g., added to the fibers with the binder. Examples of such abrasive include aluminum oxide, pumice, silica and silica compounds. If pad 10 is intended to effect a suitable scouring action on very delicate surfaces without scratching such surfaces, a suitable abrasive that will not significantly scratch the delicate surfaces, but is still sufficient to remove soils is employed, such as, for example, aluminum oxide having a Mohs hardness in the range of about 7.5 to about 10.5.

Pad 10 includes a predetermined amount of cleansing composition 14, contained within web 12, suitably in the range of about 0.8 to about 2.0 grams of dry cleaning composition per gram of web material, and, preferably about one (1) gram of cleaning composition per gram of web material. The amount of cleansing composition 14 contained within web 12, is chosen to supply a convenient economical soap that will last for 10 uses based on 15 pad revolutions per 15 second per use. The cleaning composition is a waxy solid, e.g., similar to a bar like solid soap, at typical room temperatures, and preferably provides good foaming, surface lubricity and soil removal.

Cleansing composition 14 is suitably a surfactant blend, the end product of a liquid surfactant which is uniformly dispersed in the web and dried, as hereinafter described. Cleansing composition 14 suitably comprises nonionic and anionic surfactants, hydrotropes, alkali agents and a suitable solvent (e.g., water). For example, the cleaning composition includes: one or more nonionic surfactant, such as high hydrophilic-lipophilic balance (HLB) alkyl ethoxylated phenol, (a high HLB) alkyl ethoxylated alcohol, coconut monoethanolamide, stearic monoethanolamide, coconut diethanolamide and amine oxide; one or more anionic surfactant such as an alkali metal alkylbenzene sulfonate, sodium dodecylbenzene sulfonate, sodium undecylbenzene sulfonate, potassium dodecylbenzene sulfonate, potassium undecylbenzene sulfonate, sodium lauryl sulfate, and sodium lauryl ethyl sulfate; an amphoteric, such as cocamidopropyl betaine; one or more alkali agents selected from the group of sodium hydroxide, potassium hydroxide, sodium carbonate, and potassium carbonate; one or more hydrotropes such as sodium xylene sulfonate, sodium benzene sulfonate and sodium toluene sulfonate; and a suitable solvent such as water, an alcohol, or a glycol.

The preferred blend comprises water, stearic monoethanolamide (SMA), coconut monoethanolamide (CMA) sodium dodecylbenzene sulfate (ABS), sodium xylene sulfonate (SXS), sodium hydroxide and sodium lauryl sulfate (SLS). More specifically, the preferred dried surfactant blend (in solid form in pad 10) contains SMA in the range of about 5 to about 25, and preferably 16, weight percent, CMA in the range of about 20 to about 60, and preferably 41, weight percent, sodium dodecylbenzene sulfate (ABS) in the range of about 10 to about 20 and preferably 15, weight percent, SXS in the range of about 5 to about 25 and preferably 16, weight percent, sodium hydroxide in excess of about 0.1 weight percent, and sodium lauryl sulfate in the range of about 5 to about 25 and preferably 10, weight percent. Alternatively, the cleaning composition may comprise fatty acid based soaps such as tallow fatty acid, coconut fatty acid, or a mixture of both. The soap is suitably liquid at elevated temperatures, with a relatively high temperature set point, of a semi-solid bar-like character at typical room temperatures, and exhibits good cleaning and foaming performance.

Figure 2:
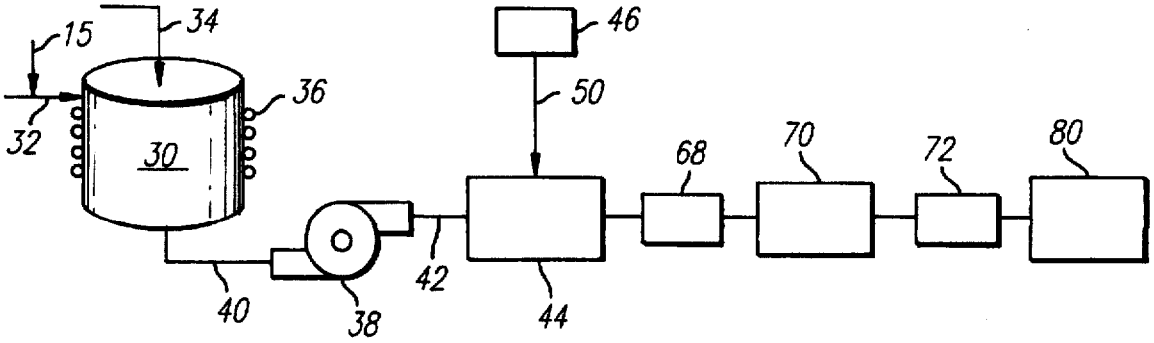
FIG. 2 is a schematic of a process and apparatus for making the cleansing pad of the present invention.

Referring now to FIG. 2, in accordance with one aspect of the present invention, pad 10 is formed by controllably dispensing a liquid form of the cleaning composition over a moving web 50 of three dimensional lofty nonwoven material (the material of body 12 of pad 10). The temperature, composition, water content and viscosity of the liquid cleaning composition, flow rate onto the lofty material, and the speed of advancement of the web, are chosen in accordance with the nature and thickness of the lofty material of the web to ensure that the liquid adequately penetrates into the web and is uniformly distributed within the web to effect retention of a desired amount of blend, while maintaining acceptable levels of loss of blend.

The process is effected using: a suitable heated tank 30 for holding a liquid cleaning composition blend and releasing the cleaning composition blend as a liquid of predetermined viscosity at predetermined pressure; a water line 34 for controllably providing water to tank 30; a pump 38, cooperating with respective lines (e.g., pipes) 40 and 42, for drawing the liquid blend from tank 30,; an impregnation station 44 for controllably dispensing the liquid blend onto web 50; a suitable tranport mechanism 46, 68 for effecting controlled movement of web 50 past impregnation station 44; a conventional two stage drier 70; and a conventional die cutter 80.

The cleaning composition, typically a waxy solid at room temperature, is maintained in liquid form in tank 30 to facilitate impregnation of web 50. For example, the preferred cleaning composition is, as noted above, a surfactant blend suitably comprises nonionic and anionic surfactants, hydrotropes, alkali agents and a suitable solvent (e.g., water). Surfactant blends are typically commercially available, in liquid form, shipped in heated tanks maintained at temperatures in excess of a predetermined value (e.g., greater than 160° F.) during transit to ensure the blend remains liquid. The starting hot liquid blend is suitably transferred to tank 30 through a pipe 32. Preferred starting blend is a viscous, white, hazy paste material that contains about 10 weight percent stearic monoethanolamide; about 25 weight percent coconut monoethanolamide; about 9 weight percent sodium dodecylbenzene sulfonate; about 25 weight percent sodium xylene sulfonate (40% active); about 0.1 weight percent sodium hydroxide, in excess; about 21 weight percent sodium lauryl sulfate (30% active); and about 10 weight percent water.

Although the above composition is preferred, the relative amount of each component may vary. For example, stearic monoethanolamide may be in the range of about 8 to about 12 weight percent; coconut monoethanolamide may be in the range of about 20 to about 40 weight percent; dodecylbenzene sulfonic acid may be in the range of about 5 to about 15 weight percent; sodium xylene sulfonate (40% active) may be in the range of about 1 to about 35 weight percent; sodium hydroxide (50% active) may be in the range of about 1 to about 4 weight percent; sodium lauryl sulfate (30% active) may be in the range of about 16 to about 26 weight percent; and water to balance weight percent to 100%.

Stearic monoethanolamide (SMA) is used as an emulsifier and to raise the melting point of the blend. Coconut monoethanolamide is a foam booster, foam stabilizer, emulsifier as well as a surface lubricant. Dodecylbenzene sulfonic acid reacts with sodium hydroxide to form a soil cleaner (emulsifier), sodium dodecylbenzene sulfonate. Sodium xylene sulfonate is a hydrotype used as a phase stabilizer. Sodium hydroxide is an alkaline source for neutralizing the dodecylbenzene sulfonic acid. Sodium lauryl sulfate is an inexpensive soil cleaner (emulsifier) and good flash foamer but is not as tolerant of hard water as sodium dodecylbenzene sulfonate.

Alternative starting blends of cleaning composition may be used. For example, stearic monoethanolamide may be replaced by a high HLB alkyl ethoxylated phenol, coconut monoethanolamide by an amine oxide, dodecylbenzene sulfonic acid by a high HLB alkyl ethoxylated phenol or alcohol, or mixture of both, sodium xylene sulfonate by sodium benzene sulfonate or sodium toluene sulfonate, sodium hydroxide by sodium carbonate, potassium carbonate or potassium hydroxide, and sodium lauryl sulfate by a sodium lauryl ether sulfate.

Water is added to tank 30 (via line 34) together with the starting blend (via line 32) to regulate the viscosity of the blend in tank 30, (and thus, to some extent the weight ratio of cleaning composition to web material in pad 10). The hydrated (diluted) surfactant blend, at a preferred dilution of 0.20 pounds of water to a pound of starting blend, is routed to impregnation station 44 for application to web 50. The composition of the preferred hydrated surfactant blend contains about 8 weight percent stearic monoethanolamide; about 20 weight percent of coconut monoethanolamide; about 7 weight percent dodecylbenzene sulfonic acid; about 20 weight percent sodium xylene sulfonate; about 0.1 weight percent sodium hydroxide; about 17 weight percent sodium lauryl sulfate and water to balance to 100 weight percent.

The temperature of the mixture in tank 30 is maintained within a predetermined range of temperatures (e.g., from about 150° F. to 170° F.), suitably using a heat jacket 36 to maintain the desired viscosity. For example, the viscosity of the preferred hydrated surfactant blend in tank 30 is 80 cps at 150° F., 100 cps at 140° F., 134 cps at 130° F., and 160 cps at 120° F. If the temperature of the blend in tank 30 falls below 120° F., blend tends to become too viscous and difficult to use in the practice of the process of the present invention. On the other hand, if the temperature of the blend is too high (e.g., above 170° F.) the viscosity of blend may be too low (e.g., 40 cps) for suitable impregnation of web 50.

The hydrated (diluted) cleansing composition blend is applied to web 50 at impregnation station 44. Pump 38 suitably draws the surfactant liquid blend from tank 30 through line 40 and transfers it to impregnation station 44 through line 42. If desired, lines 40 and 42 may be insulated to retain heat, or may be heated to maintain the blend at the desired viscosity.

Web 50 (from which pads 10 are formed) passes through impregnation station 44. As previously noted, web 50, may be any high loft polyester nonwoven material matted and bonded through any of the well known web forming and bonding processes. Web 50 is preferably a high loft nonwoven material constructed of filaments of blue homopolymer polyester fibers made through a dry air or air laid web forming process with binders, and, if desired abrasives, and a needle punch bonding process. An example of such material includes about 63 percent resin binder, has a density of about 26.8 oz./sq.yd. and an abrasiveness of about 2.0 grams removed/minute provided by 21 percent Aluminum Oxide abrasive. Web 50 is typically supplied in rolls of a predetermined length, width and thickness, e.g., about 30–35 yards long, about 39 inches wide and a thickness in the range of about 0.125 to 3 inches. When pad 10 is intended to be used in the human hand, web 50 is typically from 0.75 to about one (1) inch, and preferably 0.80 inches.

Transport mechanism 46 causes web 50 to pass through impregnation station 44 at a predetermined rate. Transport mechanism 46 may be a conventional web feed conveyor or any other suitable material handling apparatus.

Figure 3:
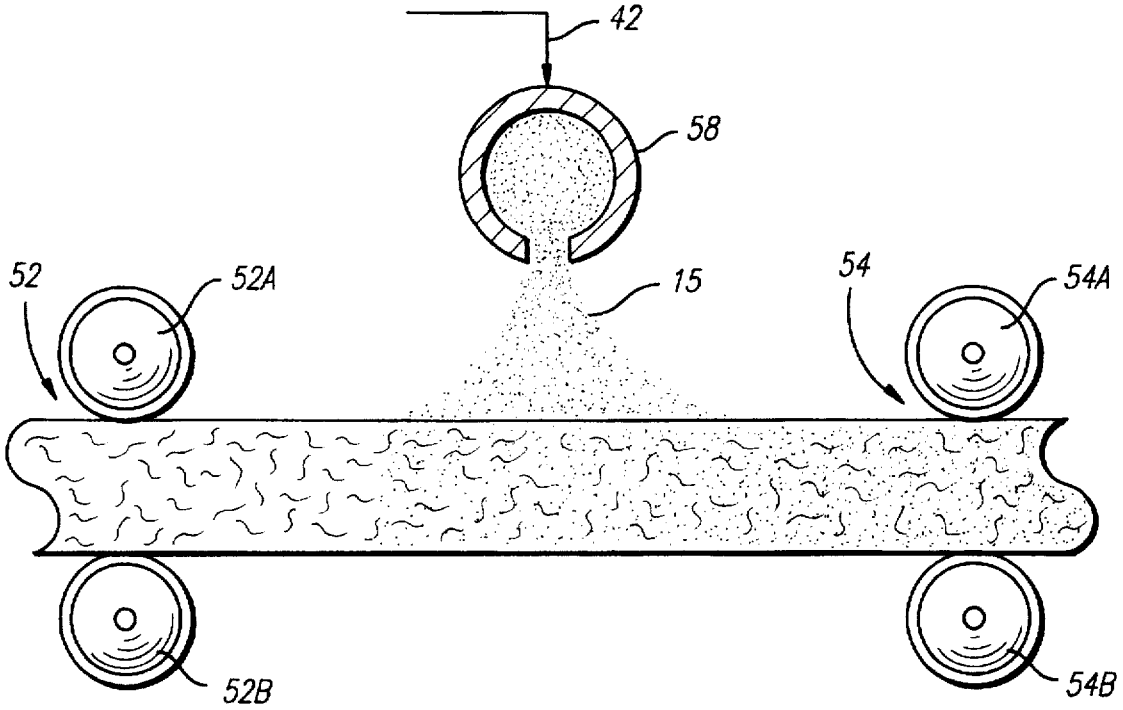
FIG. 3 is a partial, cross-sectional schematic of the impregnation section of the process and apparatus shown in FIG. 2.
Figure 4:
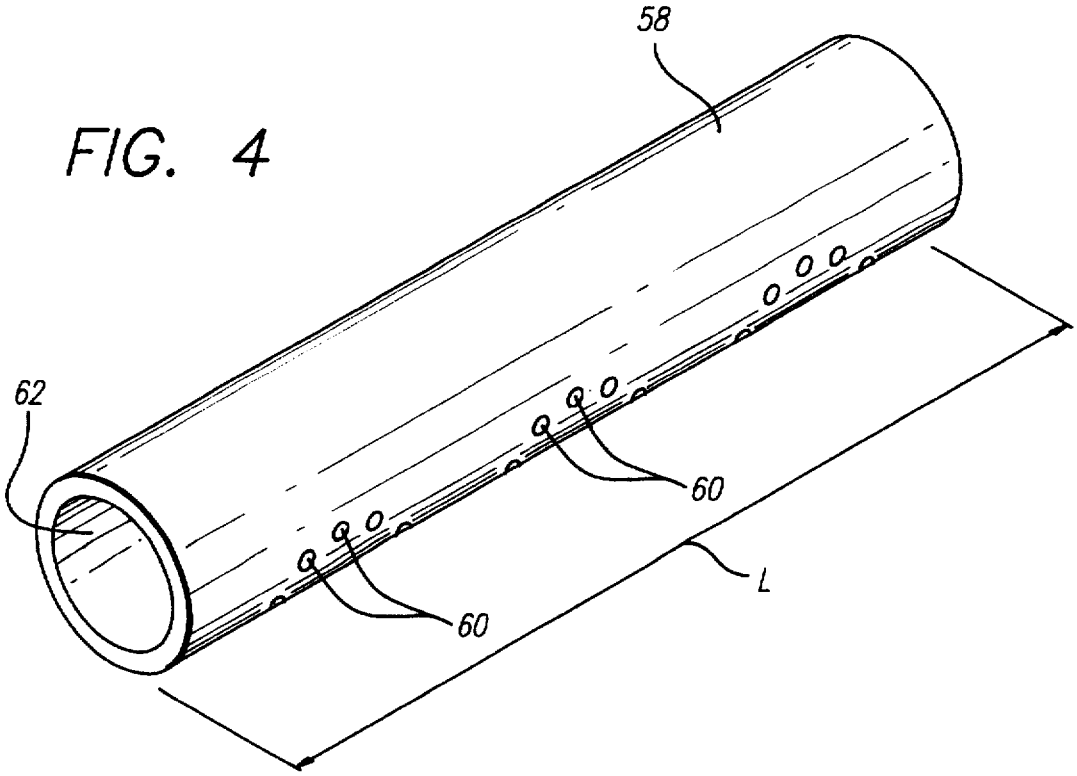
FIG. 4 is a partial, perspective view of the impregnation section of the process and apparatus shown in FIG. 2.

Referring now to FIGS. 3 and 4, impregnation station 44 suitably comprises respective guide and compression rollers 52 and 54, and an applicator manifold 58. Guide and compression rollers 52 and 54, including roller wheels 52A, 52B and 54A, 54B for engaging material 50, maintain material 50 in a substantially horizontal position and direct it horizontally under applicator manifold 58. As roller wheels 52A, 52B, 54A and 54B rotate, nonwoven material 50 advances at a predetermined speed, suitably in the range of about 11 feet per minute to about 19 feet per minute. Applicator manifold 58 receives the cleaning composition at a predetermined pressure, e.g., in the range of about 18 psig to about 22 psig, and preferably about 20 psig. While use of pump 38 to generate the desired pressure level tends to provide better consistency, pressure may be provided by alternative mechanisms, such as by compressed air.

Manifold 58 is suitably heated to maintain the cleaning composition at a predetermined temperature e.g., about 160° F., and is disposed at a relatively short predetermined distance (e.g., about zero to two centimeters) from web 50, sufficiently close to web 50 to ensure that the desired viscosity of the cleaning composition blend is maintained to facilitate the desired flow of cleaning composition into web 50. The cleaning composition is extruded from applicator manifold 58 into advancing material 50 about three to four feet in front of the trailing compression roller (e.g., 54), at which point web 50 is compressed by a predetermined amount, e.g., 0.25 inches.

Referring now to FIG. 4, applicator manifold 58 is preferably a horizontal pipe extending transversely over material 50 (preferably, 90° to direction of travel). A plurality of apertures 60 are formed in applicator manifold 58 providing fluid communication between interior 62 and the exterior thereof. Apertures are arranged in a predetermined configuration, e.g., an "S" configuration along a suitable length L to effect an optimum distribution of cleaning composition in web 50. The diameter of apertures 60 are suitably in the range of about 0.0312 inches to about 0.25 inches, preferably, about 0.0625 inches. Length L is chosen to ensure adequate impregnation and minimized loss of cleaning composition, e.g., about one inch smaller than the width of material 50.

The cleaning composition is extruded, or otherwise flows under pressure through apertures 60 onto web 50. Several factors affect the amount of blend impregnated in web 50, the loss of blend, and the consistency and the uniformity of the impregnation. Those factors include the flow rate, temperature, composition, water content and viscosity of the cleaning composition flowing onto material 50; the speed of advancement of web 50 on the compression roller; and the nature and thickness of material 50. Different blends of cleaning composition will require a different set of conditions (parameters for the above factors) to obtain an optimized surfactant distribution. In the case where the preferred cleaning composition, the surfactant blend described above with 0.25 pounds of water added thereto per pound of starting blend, and web 50 is the preferred material described above with a thickness of about 0.8 inches, very satisfactory impregnation was accomplished with minimal loss of surfactant blend at a material 50 advancement speed on the roller compression of about 11 feet per minute, a blend temperature of about 150° F., a web 50 width of about 19.5 inches, a applicator manifold 58 having apertures 60 with a diameter of about 0.0625 inches and spaced in an "S" configuration over a length L of about 20 inches long, and a surfactant blend pressure in applicator manifold 58 of about 20 psig.

Referring again to FIG. 2, after web 50 is impregnated with the liquid blend it is conveyed by transfer mechanism 68 (such as a conveyor) to drier 70. Drier 70 may be any conventional, two-stage, convection drier, such as, for example, an InFretrol convection drier. Drier 70 includes a first stage where material 50 is heated to a first predetermined temperature, e.g., equal to the boiling point of the solvent (212° F. for water) or greater, preferably about 280° F., to drive off the water present in web 50; and a second stage where material 50 is cooled by air flowing at room temperature to harden the cleaning composition blend. It is desirable that drier 70 dry web 50 and the cleaning composition residing therein to bring the moisture content of the total material into the range of between about ten (10) percent to about 25% moisture, and preferably about 10 percent. At that moisture level, the material can be handled easily and the die cutting of the material to pads is more effective. However, if the moisture content is reduced too much, e.g., to less than ten (10) percent, the edges of the pads tend to crimp during the cutting process.

The parameters of the drying cycle, including the drying time, the rate at which material 50 is passed through drier 70, the drying temperature, and the air flow rate in drier 70, are set in accordance with the moisture content of cleaning composition, the desired moisture content of the dried product and the type of drier used. Where drier 70 is a two-stage dryer having a gas-fired furnace for a first stage and the second stage blows ambient air with an adjustable conveyor speed, web 50 is the above described preferred material having a thickness of about 0.8 inches, and the cleaning composition is the above described preferred surfactant blend with the preferred amount of water content, a satisfactory drying to a desirable moisture content of about ten (10) percent can be achieved by passing the material 50 through the first and second stages of drier 70 at a rate of 6 ft./minute. If desired, a plurality of passes of web 50 through one or both stages of drier 70 may be employed.

After drying, web 50 is transferred using a suitable transfer mechanism 72, such as a conveyor, to die cutter 80 where web 50, having the dried cleaning composition therein, is cut to make scouring pads 10.

The process described herein can be utilized to impregnate nonwoven material with a variety of cleaning compositions. As noted above, a surfactant blend is preferred. However, the subject process may be used to impregnate web 50 with e.g., fatty acid based soaps such as tallow fatty acid, coconut fatty acid, or a mixture of both. The parameters used in the process would be adjusted to accomplish the desired results.

The foregoing describes preferred embodiments of the present invention known to the applicants at the time of filing. Such embodiments, however, are merely exemplary. The invention is not limited to the specific forms described. Modifications to the embodiments described above are contemplated, may be made within the scope of the invention, as defined by the claims.

I claim:

1. A process for substantially uniformly dispersing a controlled amount of a dried cleansing composition throughout a body of integrated nonwoven lofty open material, comprising the steps of:

feeding a web of the integrated nonwoven lofty open material along a selected web path at a selected rate;

maintaining a liquid blend of the cleaning composition at a selected viscosity;

transferring the liquid blend to an applicator, the applicator being disposed at a selected point along the web path, offset at a selected distance above the web;

flowing the liquid blend from the applicator onto the web at a selected flow rate to impregnate the web with the liquid blend, the selected distance between applicator and web being such that the liquid blend flowed onto the web maintains a desired viscosity to facilitate a desired flow of cleaning composition into the web; and cooling the impregnated web to harden the cleaning composition blend.

2. The method of claim 1, further comprising the step of heating the impregnated web to bring the moisture content of the web into a selected range of percentage moisture prior to cooling.

3. The method of claim 2 wherein selected range of percentage moisture is between 10 percent to 25% moisture.

4. The method of claim 2, wherein the moisture content of the web after heating is approximately 10 percent.

5. The method of claim 2 wherein the heating step comprises heating the impregnated web to a selected drying temperature to drive off the water present in the web.

6. The method of claim 5 wherein the liquid blend includes a solvent and the selected drying temperature is greater than the boiling point of the solvent.

7. The method of claim 1 wherein the cooling step is effected by air flowing at room temperature.

8. The method of claim 1 including the step of subsequent to flowing the liquid blend onto the web at point along the web path a selected distance from the applicator, compressing the web by a selected amount.

9. The method of claim 1 further comprising the step of heating the applicator to maintain the cleaning composition exiting the applicator at a selected temperature.

10. The method of claim 9 wherein the cleaning composition exiting the applicator is maintained at about 160° F.

11. The method of claim 1 wherein the selected speed of the web relative to the applicator is in accordance with characteristics of the web.

12. The method of claim 1 wherein the web, subsequent to the cooling step includes a selected ratio by weight of hardened cleaning composition to web material.

13. The method of claim 11 wherein the selected ratio by weight of hardened cleaning composition to web material is about 0.8 to about 1.2 grams of hardened cleaning composition per gram of web material.

14. The method of claim 11 wherein the selected ratio by weight of hardened cleaning composition to web material is 1 gram of hardened cleaning composition per gram of web material.

15. The method of claim 1 wherein the cleaning composition is a surfactant.

16. The method of claim 1 wherein the cleaning composition is the end product of a liquid surfactant blend which comprises nonionic and anionic surfactants, hydrotrope, alkali agent and a solvent.

17. The method of claim 1 wherein the cleaning composition is the end product of a liquid surfactant blend which comprises: at least one nonionic surfactant selected from the group of high hydrophilic-lipophilic balance (HLB) alkyl ethoxylated phenol, (HLB) alkyl ethoxylated alcohol, coconut monoethanolamide, stearic monoethanolamide, coconut diethanolamide and amine oxide; at least one anionic surfactant selected from the group of alkali metal alkylbenzene sulfonate, sodium dodecylbenzene sulfonate, sodium undecylbenzene sulfonate, potassium dodecylbenzene sulfonate, potassium undecylbenzene sulfonate, sodium lauryl sulfate, and sodium lauryl ethyl sulfate; at least one alkali agents selected from the group of sodium hydroxide, potassium hydroxide, sodium carbonate, and potassium carbonate; at least one hydrotropes selected from the group of sodium xylene sulfonate, sodium benzene sulfonate and sodium toluene sulfonate; and a solvent selected from the group of water, alcohols, and glycols.

18. The method of claim 1 wherein the cleaning composition is the end product of a liquid surfactant blend which contains water, stearic monoethanolamide, coconut monoethanolamide, dodecylbenzene sulfonic acid, sodium xylene sulfonate, sodium hydroxide and sodium lauryl sulfate.

19. The method of claim 1 wherein the step of maintaining a liquid blend of the cleaning composition at a selected viscosity comprises the steps of combining a starting blend of cleaning composition with a solvent to form the liquid blend, and controlling the temperature of the liquid blend.

20. The method of claim 18 wherein the starting blend comprises approximately 10 weight percent stearic monoethanolamide; approximately 25 weight percent coconut monoethanolamide; approximately 9 weight percent sodium dodecylbenzene sulfonate; approximately 25 weight percent sodium xylene sulfonate (40% active); approximately 0.1 weight percent sodium hydroxide, in excess; approximately 21 weight percent sodium lauryl sulfate (30% active); and approximately weight 10 percent water.

* * * * *